US006644512B2

(12) United States Patent
Li et al.

(10) Patent No.: US 6,644,512 B2
(45) Date of Patent: Nov. 11, 2003

(54) FAUCET FOR A DRINKING-WATER DISPENSER

(75) Inventors: Wen Li, Shunde (CN); Xiao-Lin Wu, Shunde (CN)

(73) Assignee: GD Midea Holding Co., Ltd., Shunde (CN)

( * ) Notice: Subject to any disclaimer, the term of this patent is extended or adjusted under 35 U.S.C. 154(b) by 7 days.

(21) Appl. No.: 10/096,608

(22) Filed: Mar. 13, 2002

(65) Prior Publication Data

US 2003/0071065 A1 Apr. 17, 2003

(30) Foreign Application Priority Data

Sep. 30, 2001 (CN) ..... 1265127

(51) Int. Cl.[7] ..... B67B 5/00
(52) U.S. Cl. ..... 222/153.03; 251/95; 222/153.14
(58) Field of Search ..... 222/153.03, 153.04, 222/153.12, 153.13, 153.14, 509; 251/89, 95, 101, 102, 103, 104, 105, 106, 107, 108, 109, 110; 239/569, 579

(56) References Cited

U.S. PATENT DOCUMENTS 2,030,510 A * 2/1936 Griffiths ..... 251/101
2,342,635 A * 2/1944 Barber et al. ..... 137/384
2,453,450 A * 11/1948 Molloy ..... 251/44
4,693,400 A * 9/1987 Frahm et al. ..... 222/518
4,848,600 A * 7/1989 Dark ..... 222/498
5,363,880 A * 11/1994 Hsieh ..... 137/625.17
5,470,044 A * 11/1995 Chi ..... 251/98
5,551,265 A * 9/1996 Garman et al. ..... 70/177
5,632,294 A * 5/1997 Benton ..... 137/1
5,762,317 A * 6/1998 Frahm et al. ..... 251/95
6,079,448 A * 6/2000 Lee ..... 137/801
6,347,784 B1 * 2/2002 Philipps-Liebich et al. ... 251/92

* cited by examiner

*Primary Examiner*—Paul J. Hirsch
*Assistant Examiner*—Frederick C. Nicolas
(74) *Attorney, Agent, or Firm*—William E. Pelton, Esq.

(57) ABSTRACT

A faucet for a water dispenser has a seat secured on a front housing. The seat has at least one nozzle formed therein. At least one button is provided above the seat to control the nozzle's on/off modes when a user presses the button inwards. The button has a slot longitudinally defined therein and a locking key is movably received in the slot. The locking key has a finger extending downwards and blocked by the front housing. The button cannot be pressed when the locking key in a locked position, and can be pressed when the locking key is moved to an unlocked position to retract the finger.

8 Claims, 3 Drawing Sheets

FAUCET FOR A DRINKING-WATER DISPENSER

BACKGROUND OF THE INVENTION

1. Field of the Invention

The present invention is related to a drinking-water dispenser, and more particularly to a tap of the water dispenser.

2. Description of Related Art

There are two types of faucets for drinking-water dispensers. One type of faucet has a lever mounted above a nozzle. When the lever is pressed, water flows out from the nozzle. However, a user must keep on pressing the lever to keep a constant flow of water, which is very inconvenient.

The other type of faucet has a button to control the nozzle's on/off statuses. When the button is pressed inwards adequately, the button can be positioned to keep the water flowing without the need for continual pressing by the user. When the button is pressed again, the button can return to turn off the faucet.

However, a drawback to this faucet is that the button may not be pressed for the second time and thus the water will keep flowing in a wasteful manner. Furthermore, some water dispensers provide very hot water that can be mixed with the cold water but the danger arises that a person, especially a child may suffer scalds by unwittingly accessing only the hot water.

Therefore, the invention provides an improved faucet that is controlled by buttons to mitigate and/or obviate the aforementioned problems.

SUMMARY OF THE INVENTION

The main objective of the invention is to provide a safe faucet that cannot be turned on in a locked status to prevent the faucet from unintentional flow of water.

Other objects, advantages and novel features of the invention will become more apparent from the following detailed description when taken in conjunction with the accompanying drawings.

DETAILED DESCRIPTION OF THE PREFERRED EMBODIMENT

Figure 1:
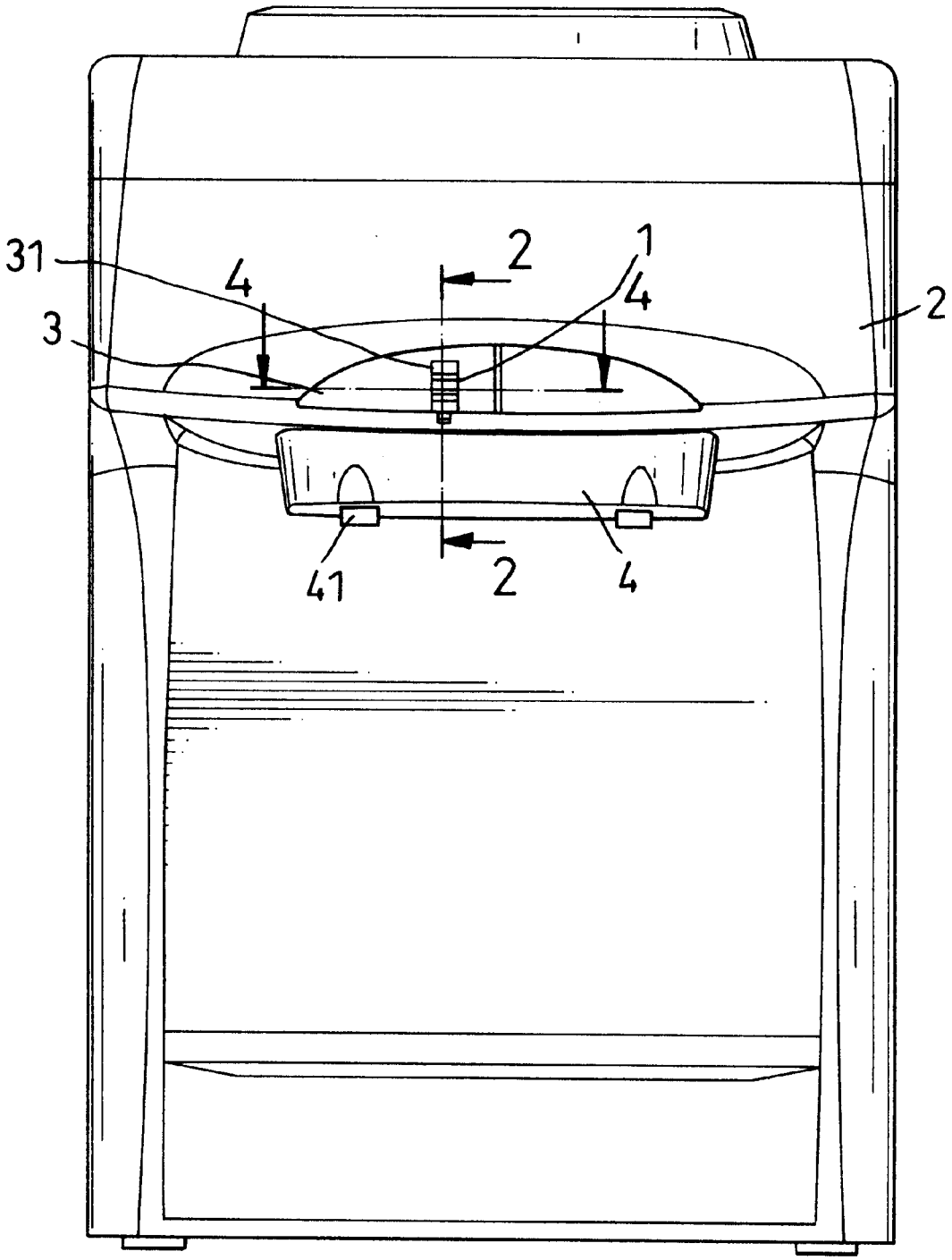
FIG. 1 is a front view of faucets in accordance with the invention mounted on a water dispenser.
Figure 2:
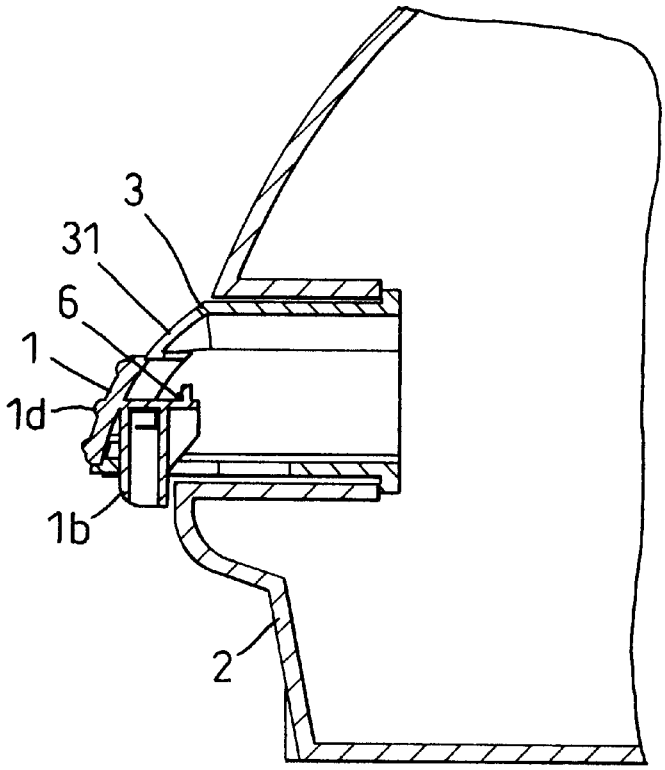
FIG. 2 is a sectional view along the line "A—A" in FIG. 1.

Referring to FIGS. 1 and 2, a faucet in accordance with the invention is mounted on a front housing (2) of a water dispenser. The faucet has a pair of buttons (3) to respectively control the on/off statuses of a pair of nozzles (41), wherein the left nozzle is communicated with a hot water chamber (not shown or numbered), and the right nozzle is communicated with a cool water chamber (not shown or numbered).

Figure 3:
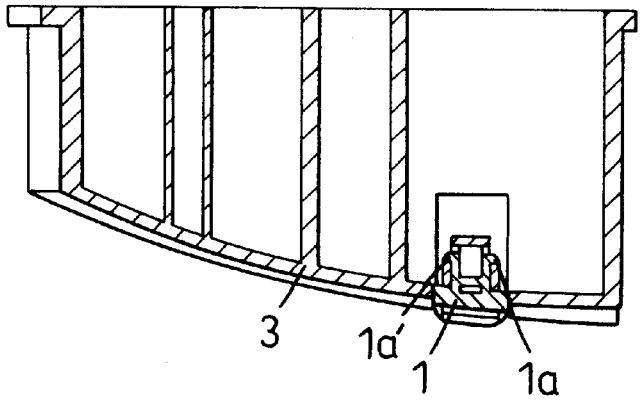
FIG. 3 is a sectional view along the line "B—B" in FIG. 1.

The nozzles (41) are formed in a seat (4) secured on the front housing (2) of the dispenser. The left button (3) controlling the left nozzle (41) from which hot water is discharged has a slot (31) longitudinally defined therein. A locking key (1) is inserted in and movable along the slot (31). A finger **(1*b*) is formed on an inner side of the locking key (1) and extending downwards. When the locking key (1) is located at the bottom of the slot (31), the button (3) can not be pressed because the finger (1*b*) is blocked by the front housing (2). Before the button is pressed, the locking key (1) must be pushed up along the slot (31). In this embodiment, the finger (1*b*) is integrated with the locking key (1), but a finger that is a separate component and mounted on the locking key (1) is also acceptable. At least one recess or one protrusion (1*d*) is formed on the outer surface of the key (1) to increase the friction so as to facilitate easy pushing of the key (1). Referring to FIG. 3, the key (1) further has two lugs (1*a*, 1*a*') respectively formed at two sides thereof and located in the button (3) to prevent the locking key (1) from escaping from the slot (31)**.

Figure 4:
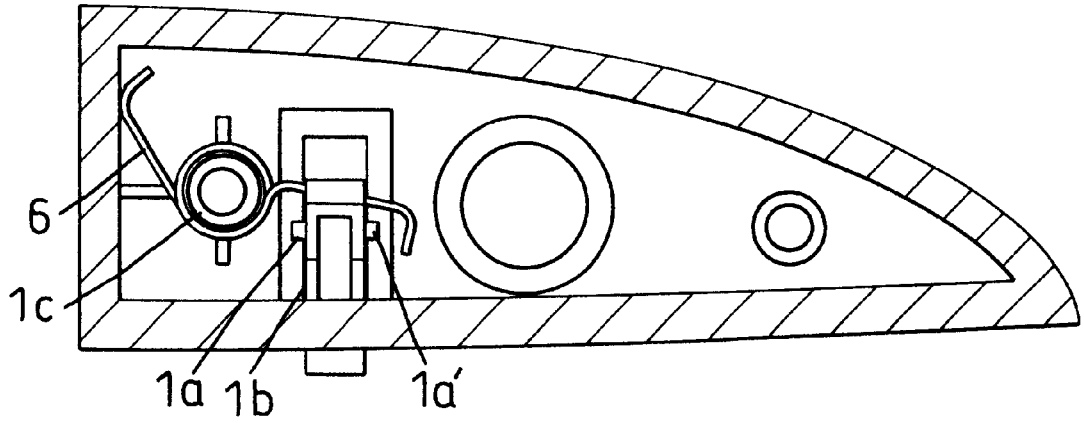
FIG. 4 is a top view of a spring of the faucet in a non-operated status.
Figure 5:
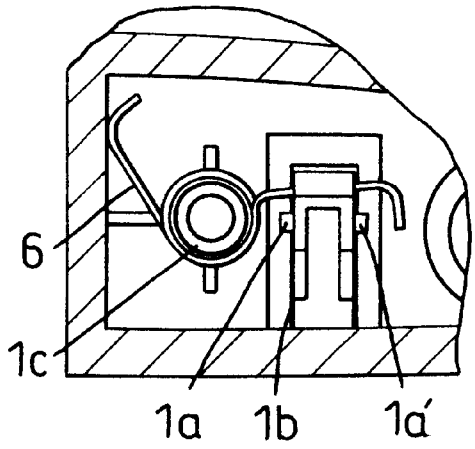
FIG. 5 is a top view of a spring of the faucet in an operated status.

Referring to FIGS. 2, 4, and 5, a pole **(1*c*) is formed in the button (3) and beside the locking key (1). A resilient member (6) is mounted on the pole (1*c*), and has a first arm (not numbered) abutting an inner wall of the button (3) and a second arm (not numbered) fastened in the locking key (1). Under the force of the resilient member (6), the locking key (3) pushed upwards can return to the bottom of the slot (31)**.

According to the present invention, under the force of the resilient member (6), the locking key (1) is originally located at the bottom of the slot (31), and the button (3) can not be pressed inwards due to the finger **(1*d*) being blocked by the front housing (2). When a user wants to access hot water from the dispenser, the locking key (1) must be pushed up to retract the finger (1*d*), whereby the button (3) can be pressed inwards and hot water flows out from the nozzle (41). When the user releases the button (3) after accessing the water, the locking key (1) will return to the bottom of slot (31) under the force of the resilient member (6), so that the button (3)** can not be pressed unintentionally.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A faucet for a water dispenser, comprising:

a seat (4) secured on a front side (2) of the water dispenser, the seat (4) having at least one nozzle (41) formed therein; and at least one button (3) provided above the seat (4) and controlling the nozzle (41) to on and off modes by pressed towards the front side (2), the at least one button (3) having a slot (31) longitudinally defined therein and a locking key (1) movably received in the slot (31), wherein the at least one button (3) cannot be pressed to turn on the nozzle (41) when the locking key (1) is in a locked status, and the button (3) can be pressed to turn on the nozzle (41) when the locking key (1) is in an unlocked status.

2. The faucet as claimed in claim 1, wherein the locking key (1) has a finger **(1*b*) extending away from the button (3) and blocked by the front side (2)** in the locked status.

3. The faucet as claimed in claim 1, wherein the locking key (1) has two lugs (1*a,* 1*a*') respectively formed at two sides thereof and located in the at least one button (3) to prevent the locking key (1) from escaping from the slot (31).

4. The faucet as claimed in claim 2, wherein the finger (1*b*) extends vertically.

5. The faucet as claimed in claim 2, wherein the finger (1*b*) is integrated with the locking key (1).

6. The faucet as claimed in claim 1, wherein the locking key (1) has a protrusion (1*d*) formed on an outer surface thereof to provide a grip portion for a user.

7. The faucet as claimed in claim 1, wherein the locking key (1) has a resilient member (6) secured on the button (3), the resilient member (6) having a first arm extending abutting an inner wall of the button (3) and a second arm fastened in the locking key (1).

8. The faucet as claimed in claim 7, wherein the resilient member (6) is secured on a pole (1*c*) formed on the button (3) and beside the locking key (1).

* * * * *